US009855569B2

(12) United States Patent
Honeyands

(10) Patent No.: US 9,855,569 B2
(45) Date of Patent: Jan. 2, 2018

(54) SHOWER HEAD

(75) Inventor: Christopher Honeyands, Street (GB)

(73) Assignee: Kelda Showers Limited, Winchester (GB)

( * ) Notice: Subject to any disclaimer, the term of this patent is extended or adjusted under 35 U.S.C. 154(b) by 537 days.

(21) Appl. No.: 13/985,637

(22) PCT Filed: Feb. 10, 2012

(86) PCT No.: PCT/GB2012/050304

§ 371 (c)(1),
(2), (4) Date: Aug. 15, 2013

(87) PCT Pub. No.: WO2012/110790

PCT Pub. Date: Aug. 23, 2012

(65) Prior Publication Data

US 2013/0320112 A1 Dec. 5, 2013

(30) Foreign Application Priority Data

Feb. 17, 2011 (GB) ..... 1102766.1

(51) Int. Cl.
*B05B 7/06* (2006.01)
*B05B 1/26* (2006.01)
(Continued)

(52) U.S. Cl.
CPC ..... *B05B 1/26* (2013.01); *A61H 33/6036* (2013.01); *A61H 33/6052* (2013.01); *B05B 1/00* (2013.01);
(Continued)

(58) Field of Classification Search
CPC ..... B05B 7/1626; B05B 1/00; B05B 1/18; B05B 7/045; B05B 1/26; B05B 15/026;
(Continued)

(56) References Cited

U.S. PATENT DOCUMENTS 2,026,743 A 1/1936 Kurtz
3,281,864 A 11/1966 Linnehan
(Continued)

FOREIGN PATENT DOCUMENTS

CN 201313083 Y 9/2009
CN 202174022 U 3/2012
(Continued)

OTHER PUBLICATIONS

Written Opinion of the International Searching Authority, International Application No. PCT/GB2012/050304, Completed Feb. 10, 2012, dated May 4, 2012, Authorized Officer Yorick Lostetter, European Patent Office.
(Continued)

*Primary Examiner* — Jason Boeckmann
(74) *Attorney, Agent, or Firm* — Fay Sharpe LLP

(57) ABSTRACT

A shower head (40) has a passageway for a flow of pressurized air from a pressurized air supply, via a Venturi (48) having a convergent portion (46), throat (50) and divergent portion (52), to a shower discharge opening (56), and a passageway (58) for a flow of water from a water supply to a water discharge opening (60) in the Venturi. The Venturi is such that, in use, the general direction of the flow of air is turned through a substantial angle in the Venturi. This folding of the Venturi enables a compact configuration of shower head to be provided.

14 Claims, 3 Drawing Sheets

(51) Int. Cl.

| | |
|---|---|
| ***B05B 1/00*** | (2006.01) |
| ***B05B 7/04*** | (2006.01) |
| ***B05B 15/06*** | (2006.01) |
| ***A61H 33/00*** | (2006.01) |
| *B05B 1/18* | (2006.01) |
| *B05B 7/16* | (2006.01) |
| *A61H 33/02* | (2006.01) |

(52) U.S. Cl.
CPC ..... *B05B 7/045* (2013.01); *B05B 15/065* (2013.01); *A61H 33/027* (2013.01); *B05B 1/18* (2013.01); *B05B 7/1626* (2013.01)

(58) Field of Classification Search
CPC ..... B05B 15/065; A61H 33/6052; A61H 33/6036; A61H 33/027
USPC ..... 239/423, 424, 433, 434, 418
See application file for complete search history.

(56) References Cited

U.S. PATENT DOCUMENTS

| | | | | |
|---|---|---|---|---|
| 3,568,668 | A | 3/1971 | Neis | |
| 3,965,494 | A | 6/1976 | Baker | |
| 4,134,547 | A | 1/1979 | Gamst | |
| 4,341,347 | A * | 7/1982 | DeVittorio | B05B 5/03 239/3 |
| 4,426,040 | A | 1/1984 | Smith | |
| 8,857,740 | B2 * | 10/2014 | Wurz | B05B 7/0458 239/405 |
| 2007/0246577 | A1 | 10/2007 | Leber | |
| 2009/0166448 | A1 * | 7/2009 | Wurz | B05B 7/0458 239/398 |
| 2009/0202293 | A1 | 8/2009 | Kajuch et al. | |
| 2010/0252658 | A1 * | 10/2010 | Honeyands | A61H 33/028 239/398 |

FOREIGN PATENT DOCUMENTS

| | | | |
|---|---|---|---|
| DE | 19813366 | A1 | 10/1998 |
| DE | 202011001711 | U1 | 5/2011 |
| GB | 329157 | | 5/1930 |
| JP | 4122227 | A | 4/1992 |
| JP | 9262512 | A | 10/1997 |
| JP | 2000237082 | A | 9/2000 |
| JP | 2001149252 | A | 6/2001 |
| JP | 2002119435 | A | 4/2002 |
| JP | 2006116518 | A | 5/2006 |
| JP | 2007326082 | A | 12/2007 |
| WO | WO 2009/056887 | A1 | 5/2009 |

OTHER PUBLICATIONS

International Search Report, International Application No. PCT/GB2012/050304, Completed Apr. 24, 2012, dated May 4, 2012, Authorized Officer Yorick Lostetter, European Patent Office.

"Lung deposition predictions of airborne particles and the emergence of contemporary diseases", Hussain et al., theHealth 2011, vol. 2, Issue 2, pp. 51-59.

* cited by examiner

BASED ON
PRIOR ART

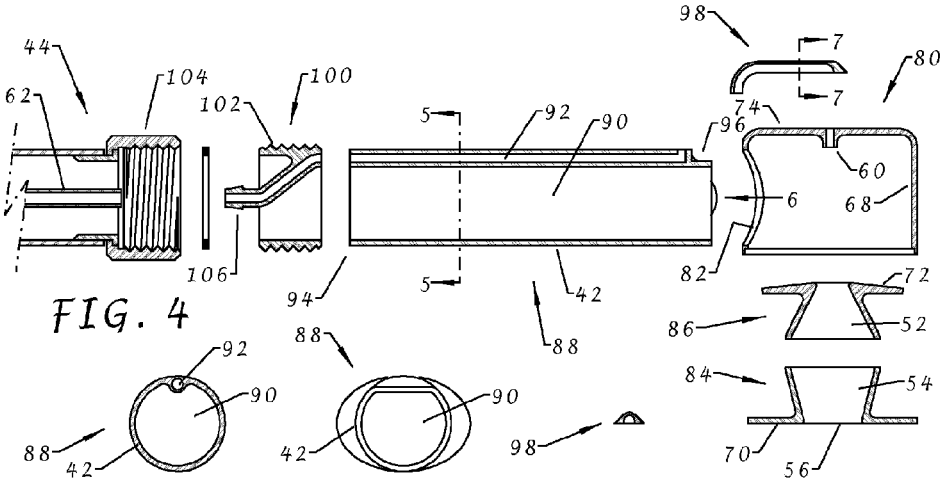
FIG. 4
FIG. 5
FIG. 6
FIG. 7
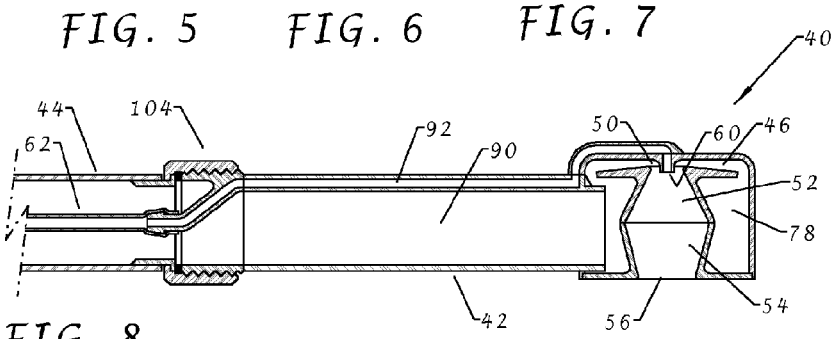
FIG. 8
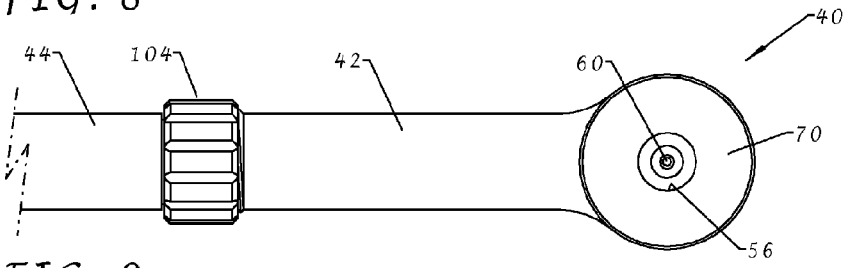
FIG. 9
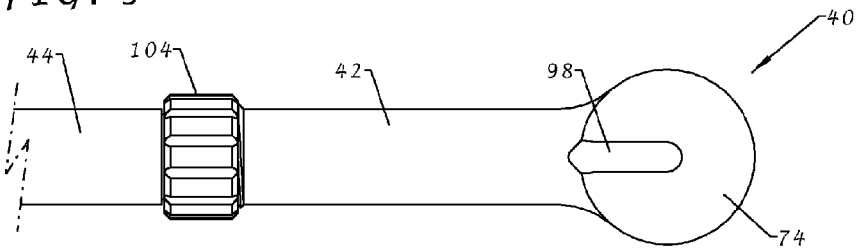
FIG. 10

SHOWER HEAD

CROSS-REFERENCE TO RELATED APPLICATIONS

This application is a 371 National Stage Entry of International application number PCT/GB2012/050304, having an international filing date of Feb. 10, 2012, which was published in English, and which claims priority to Great Britain Patent Application No. GB 1102766.1, filed Feb. 17, 2011, the entirety of which are hereby incorporated by reference as if fully set forth herein.

This invention relates to shower heads.

It is well known that showering uses less water, and therefore less energy to heat the water, that bathing. Nevertheless, there are concerns about the amount of water and energy used when showering. For example, in an attempt to reduce water and energy usage, federal regulations were introduced in the USA in 1992 limiting shower head flow rate to 2.5 US gallons of water per minute (about 9.5 liters per minute), and some cities are already imposing tighter regulations. However, many people find that such a low flow rate does not provide them with a shower that feels sufficiently powerful. As reported in an article in the online Wall Street Journal dated 13 Nov. 2009, consumers often remove the flow restrictor in the shower head to increase the flow rate (and indeed the packaging provided with some shower heads includes details of how to do this). Alternatively or additionally, they install more than one shower head in their shower cubicle.

It is known that the apparent power of a shower can be improved by mixing air with the water, for example by providing a turbine in the shower head, or by forcing the water through a Venturi which draws air into the water flow.

It is also known from patent document WO2009/056887A1 that the apparent power of the shower can be further improved by pumping air at a relatively high flow rate to the shower head, forcing the air through a Venturi, and introducing water into the air flow in the Venturi.

The type of shower head disclosed in WO2009/056887A1 is shown schematically in FIG. 1 of the accompanying drawings. The shower head 10 has a relatively large bore passageway 12 leading from a pressurised air hose 14 to a Venturi 16. Hot water from a relatively small bore water hose 18 is introduced into the air flow in the region of the throat 20 of the Venturi 16. In a divergent portion 22 of the Venturi 16, the water breaks up into droplets, which then pass through a convergent nozzle 24 which accelerates the droplets and reduces the noise produced by the shower head 10, before the droplets are discharged as a powerful shower 26 from a discharge opening 28. The shower head 10 is devoid of a rose across its discharge opening 28. The air supplied to the shower head 10 may be heated, in which case the shower head 10 may be used, after a shower, with air only, to dry the user. If the air is not heated during showering, it may be necessary for the water temperature to be slightly higher than a conventional shower for the user to feel the same effective temperature.

The arrangement disclosed in WO2009/056887A1 has many advantages over conventional showers, as detailed in WO2009/056887A1, but most importantly it has a drastically reduced water consumption and energy consumption compared with a conventional shower of the same apparent power.

The arrangement shown in FIG. 1 may be perfectly satisfactory if the shower head is fixed to a wall in a shower cubicle or above a bath tub. However, many people like also to be able to hold a shower head by hand, for example when washing particular parts of their body when showering, when washing their hair while taking a bath (if the shower head is over the bath), or when washing a pet. The shower head therefore conveniently requires some form of handle. With most conventional shower heads, the handle conveniently extends at approximately a right angle to the discharge direction of the shower head, and the water flows from its hose connected to the distal end of the handle through the handle to the discharge opening(s). However, with the arrangement shown in FIG. 1, due to the inclusion of the relatively large bore air passageway 12 and the Venturi 16 in the shower head 10 of FIG. 1, either providing a handle around the portion 30 of the air passageway 12 (as shown by the dash-dot lines 32) or as a separate element for example extending at right angles to the divergent portion 22 of the Venturi 16 and the convergent nozzle 24 (as shown by the dash-dot lines 34) would result in the shower head being cumbersome.

An aim of the present invention, or at least of specific embodiments of it, is to overcome this problem with the prior art.

In accordance with a first aspect of the present invention, there is provided a shower head having, in common with the shower head of WO2009/056887A1, a passageway for a flow of pressurised air from a pressurised air supply, via a Venturi having a convergent portion, throat and divergent portion, to a shower discharge opening, and a passageway for a flow of water from a water supply to a water discharge opening in the Venturi. By contrast to the shower head of WO2009/056887A1, in the shower head of the first aspect of the invention, the Venturi is such that, in use, the general direction of the flow of air is turned through a substantial angle in the Venturi. This folding of the Venturi, preferably at or adjacent its throat, and preferably though an angle of between 45° and 135°, enables a compact configuration of shower head to be provided, as will become apparent from the detailed description below.

The Venturi is preferably such that, in use, the general direction of the flow of air in the divergent portion of the Venturi is along an axis.

In one embodiment of the invention, the Venturi is such that, in use, the general direction of the flow of air in the convergent portion of the Venturi is also along an axis, but an axis which is at said substantial angle to the flow axis of the divergent portion of the Venturi. In this case, the shower head preferably includes an elongate handle having a distal end for connection to the air supply, the convergent portion of the Venturi being provided adjacent a proximal end of the handle and being substantially aligned with the handle, and the air passageway extending through the handle from the distal end of the handle to the convergent portion of the Venturi.

In another embodiment of the invention, the Venturi is such that, in use, the general direction of the flow of air in the convergent portion of the Venturi is radially or conically towards the throat of the Venturi. In a preferred form of this embodiment, the shower head includes a housing having a rear wall, a frusto-conical wall is disposed within the housing, with the frusto-conical wall tapering in a direction towards the rear wall and being spaced from the rear wall. The convergent portion of the Venturi is provided between the rear wall and the outer surface of the frusto-conical wall, and the throat of the Venturi is provided at least in part between the rear wall and the smaller diameter end of the frusto-conical wall. In a more preferred form, the divergent portion of the Venturi is defined by the inner surface of the frusto-conical wall. In this case, the air passageway preferably includes a plenum chamber upstream of the convergent portion of the Venturi. Again, the shower head preferably includes an elongate handle having a distal end for connection to the air supply, the plenum chamber being provided adjacent a proximal end of the handle; and the air passageway extending through the handle from the distal end of the handle to the plenum chamber. The plenum chamber preferably surrounds the divergent portion of the Venturi. All of these features add to the compactness of the shower head and also provide good symmetry in the shower pattern.

The water discharge opening may be disposed in the throat of the Venturi, but more preferably is disposed at or adjacent the beginning of the divergent portion of the Venturi.

The shower head preferably further includes a convergent nozzle downstream of the divergent portion of the Venturi. The nozzle can act to accelerate the droplets of water, shape the shower pattern and reduce the noise produced by the shower head.

The shower head is preferably devoid of a rose of the like adjacent the shower discharge opening.

In accordance with the second aspect of the invention, there is provided a shower apparatus comprising: a shower head according to the first aspect of the invention, an air blower, and a flexible air hose for connecting the air blower to the air passageway of the shower head. A flexible water hose is preferably also provided for connecting a water supply to the water passageway of the shower head. The water hose preferably extends to the shower head within the air hose so that the water hose is concealed.

Specific embodiments of the present invention will now be described, purely by way of example, with reference to the accompanying drawings, in which:

FIG. 4 is an exploded sectioned side view of parts for making a shower head in accordance with the second arrangement of FIG. 3;

FIG. 5 is a sectioned view of a handle shown in FIG. 4, taken on the section line 5-5 in FIG. 4;

FIG. 6 is an end view of the handle, as seen in the direction 6 shown in FIG. 4;

FIG. 7 is a sectioned view of one the parts shown in FIG. 4, taken on the section line 7-7 shown in FIG. 4;

FIG. 8 is similar to FIG. 4, but with the parts assembled;

FIG. 9 is a front view of the shower head of FIG. 8;

FIG. 10 is a rear view of the shower head of FIGS. 8 and 9;

Figure 2:
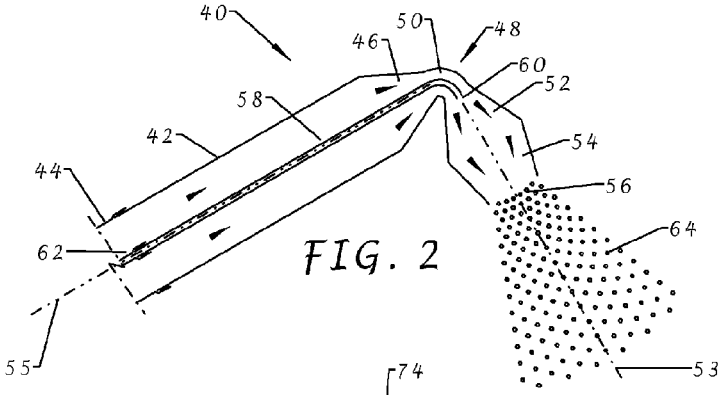
FIG. 2 is a schematic diagram of a first arrangement of shower head in accordance with the present invention.

Referring to FIG. 2, in the first exemplary arrangement of the invention, the shower head 40 has a tubular handle 42 which can be coupled at its distal end to a hose 44 for supplying pressurised air into the handle 42. A convergent portion 46 of a Venturi 48 is formed at the other end of the handle 42. Rather than extending in the same direction as the convergent portion 46 of the Venturi 48, the throat 50 of the Venturi 48 curves through approximately a right angle, and then the divergent portion 52 of the Venturi 48 extends along an axis 53 at approximately a right angle relative to the axis 55 of the handle 42 and the convergent portion 46 of the Venturi 48. The divergent portion 52 of the Venturi 48 leads to a coaxial convergent nozzle 54 having a discharge opening 56. The discharge opening 56 is completely open and devoid of a rose or the like. The shower head 40 also includes a pipe 58, of substantially smaller bore than the bore of the handle 42, extending from the distal end of the handle 42, through the handle 42 and the convergent portion 46 of the Venturi 48, and then curving through approximately a right angle through the throat 50 of the Venturi 48 to an open end 60 adjacent the beginning of the divergent portion 52 of the Venturi 48. The other end of the pipe 58 is arranged to be coupled to a hose 62, within the air hose 44, for supplying hot water at a relatively low pressure, for example with a head as small as 1 meter.

In operation of the arrangement of FIG. 2, air passes through the handle 42 to the convergent portion 46 of the Venturi 48, where it accelerates and reduces in pressure, and the flow of air is turned through approximately a right angle in the throat 50 of the Venturi 48, before entering the divergent portion of the Venturi 48, where the air decelerates and increases in pressure. Hot water is introduced into the air flow from the end 60 of the pipe 58. Due to the action of the Venturi 48, the air provides little back pressure on the water in the pipe 58 and may indeed provide suction to assist in drawing the water out of the pipe 58. As the water becomes entrained in the air flow, it breaks up into droplets in the divergent portion 52 of the Venturi 48. The stream of air and water droplets is then accelerated in the convergent nozzle 54, which also serves to reduce the noise produced by the shower head 40, before the droplets are discharged as a powerful shower 64 from the discharge opening 56.

Figure 1:
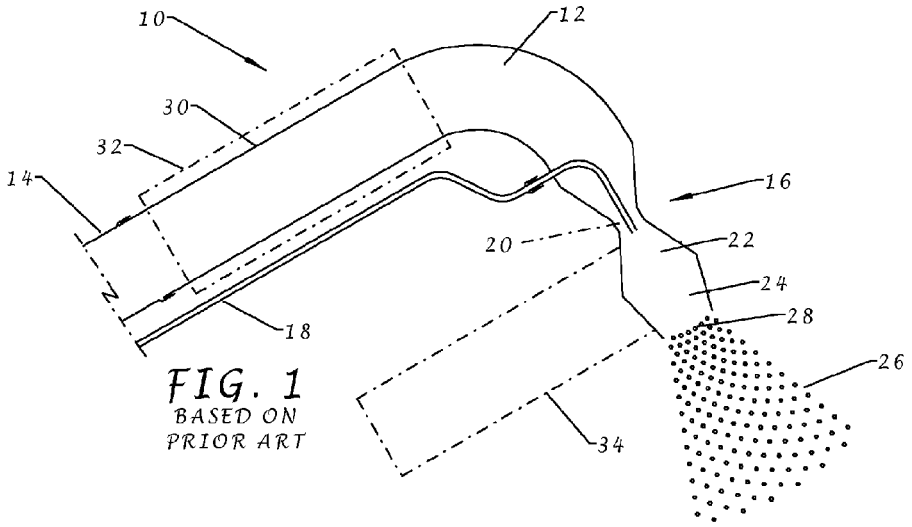
FIG. 1 is a schematic diagram of a shower head following the teachings of patent document WO2009/056887A1.

From a comparison of FIGS. 1 and 2, it can be seen that the arrangement of FIG. 2 is far more compact.

A potential problem with the arrangement of FIG. 2 is that, due to the curving of the throat 50 of the Venturi 48, the flow of water droplets through the divergent portion 52 of the Venturi 48 and the convergent nozzle 54 may be asymmetrical about the axis of the divergent portion 52 and the convergent nozzle 54, resulting in the shower 64 being asymmetrical. The second arrangement of FIG. 3 aims to avoid this potential problem.

Figure 3:
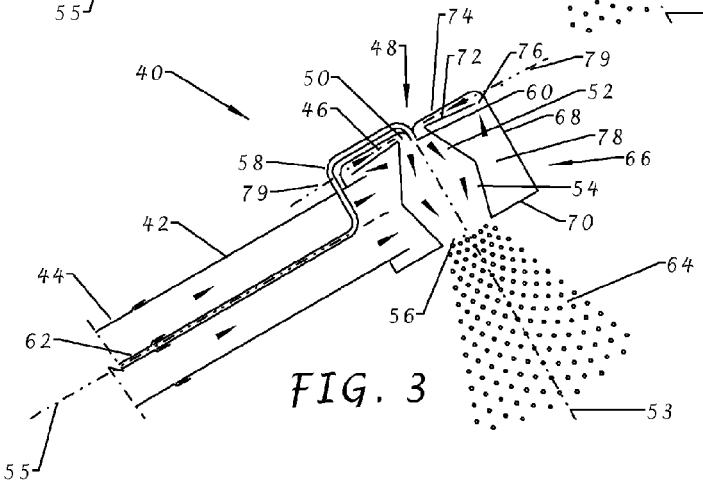
FIG. 3 is a schematic diagram of a second arrangement of shower head in accordance with the present invention.

In the exemplary arrangement of FIG. 3, a hollow, generally cylindrical body 66 is provided and the proximal end of the handle 42 passes through a side wall 68 of the body 66. The front end wall 70 of the body 66 is formed with the discharge opening 56, and the convergent nozzle 54 and divergent portion 52 of the Venturi 48 are mounted in the body 66 behind the discharge opening 56. A frusto-conical wall 72 with a large half-angle is formed around the smaller diameter end of the divergent portion 52 and is spaced from the rear end wall 74 of the body 66 with a spacing that decreases slightly the closer to the axis of the body 66. The outer diameter of the frusto-conical wall 72 is less than the internal diameter of the side wall 68 of the cylindrical body 66 so that an annular gap 76 is formed between the periphery of the frusto-conical wall 72 and the side wall 68 of the body 66. The area of the annular gap 76 between the periphery of the frusto-conical wall 72 and the side wall 68 of the body 66 is approximately equal to the cross-sectional area of the air passageway through the handle 42. The area of the cylindrical gap between the periphery of the frusto-conical wall 72 and the rear end wall 74 of the body 66 is also approximately equal to the cross-sectional area of air passageway through the handle 42. The remaining space inside the body 66 forms a plenum chamber 78. In use, air flows through the handle 42 into the plenum chamber 78, and then passes through the annular gap 76 into the space between the frusto-conical wall 72 and the rear end wall 74 of the body 66 where the air flows conically (and almost radially) inwardly towards the axis of the cylindrical body 66. The space between the frusto-conical wall 72 and the rear end wall 74 therefore forms the convergent portion 46 of the Venturi 48 due partly to the conical shape of the wall 74 and partly to the radially inward flow of the air. The transition between the convergent and divergent portions 46,52 forms the throat 50 of the Venturi 48, where the air flow turns through approximately a right angle. The rear end wall 74 of the body 68 is chamfered adjacent its centre to assist in turning the air flow in the throat 50 of the Venturi 48. The water pipe 58 exits through the wall of the handle 42 adjacent the body 68 and leads behind the body 68, where it then enters the body 68 centrally through the rear end wall 74 of the body, with the end 60 of the pipe 58 being adjacent the beginning of the divergent portion 52 of the Venturi 48 and being coaxial with the divergent portion 52 of the Venturi 48 and the convergent nozzle 54.

The air flow in the arrangement of FIG. 3 is therefore from the hose 44 through the handle 42 to the plenum chamber 78. From the plenum chamber 78, the air flows through the annular gap 76 into the convergent portion 46 of the Venturi 48, where the air flows conically, almost radially, inwardly (in the general direction indicated by the dash-dot lines 79 in FIG. 3) and accelerates due to the narrowing of the space between the frusto-conical wall 72 and the rear end wall 74 of the body 66 and due to the conical or radial radial nature of the flow. The air then turns at the throat 50 into the divergent portion 52 of the Venturi 48. Meanwhile, hot water flows from the hose 62 into the pipe 58 and is introduced into the air flow at the end 60 of the pipe 58 at the start of the divergent portion 52 of the Venturi 48. Again, due to the action of the Venturi 48, the air provides little back pressure on the water in the pipe 58 and may indeed provide suction to assist in drawing the water out of the pipe 58. As the water becomes entrained in the air flow, it breaks up into droplets in the divergent portion 52 of the Venturi 48. The stream of air and water droplets is then accelerated in the convergent nozzle 54, which also serves to reduce the noise produced by the shower head 40, before the droplets are discharged as a powerful shower 64 from the discharge opening 56. Because the air flows into the throat 50 of the Venturi 48 approximately uniformly from all radial directions, the flow of air and droplets through the divergent portion 52 of the Venturi 48, the convergent nozzle 54 and the discharge opening 56 is generally symmetrical.

An embodiment of the invention in accordance with the second arrangement of FIG. 3 will now be described in more detail with reference to FIGS. 4 to 10.

A first plastics moulding 80 generally in the form of a cylinder having one open end forms the side wall 68 and rear end wall 74. A large hole 82 is formed in the side wall 68 of the moulding 80 to receive the handle 42, and a small hole is formed in the centre of the rear end wall 74 to provide the end 60 of the water passageway. A second plastics moulding 84 provides the front end wall 70, the discharge opening 56 and the convergent nozzle 54. A third plastics moulding 86 provides the divergent portion 52 of the Venturi 48 and the frusto-conical wall 72. The first, second and third mouldings 80,84,86 are fixed together in the configuration shown in FIG. 8.

A fourth plastics moulding 88 provides the handle 42. The moulding 88 is generally tubular to provide the air passageway 90 through the handle 42. However, the wall of the moulding 88 is thickened in one part and formed with a passageway 92 for hot water extending from the distal end 94 of the handle 42 almost to its proximal end 96, where the passageway exits outwardly through the wall of the handle 42. This proximal end 96 of the handle 42 is fixed in the hole 82 in the side wall 68 of the first moulding 80, and projects to some extent into the plenum chamber 78.

A fifth plastics moulding 98 has the form of an L-shaped channel and is fixed to the first moulding 80 so as to communicate the water passageway 92 in the handle with the end 60 of the water passageway in the Venturi 48, as shown in FIG. 8.

A sixth plastics moulding 100 is fixed to the distal end 94 of the handle 42. The moulding 100 provides a screw thread 102 to which a coupling 104 of the air hose 44 can be connected, and a nipple 106, communicating with the water passageway 92, to which the hot-water hose 62 inside the air hose 44 can be fitted.

Figure 13:
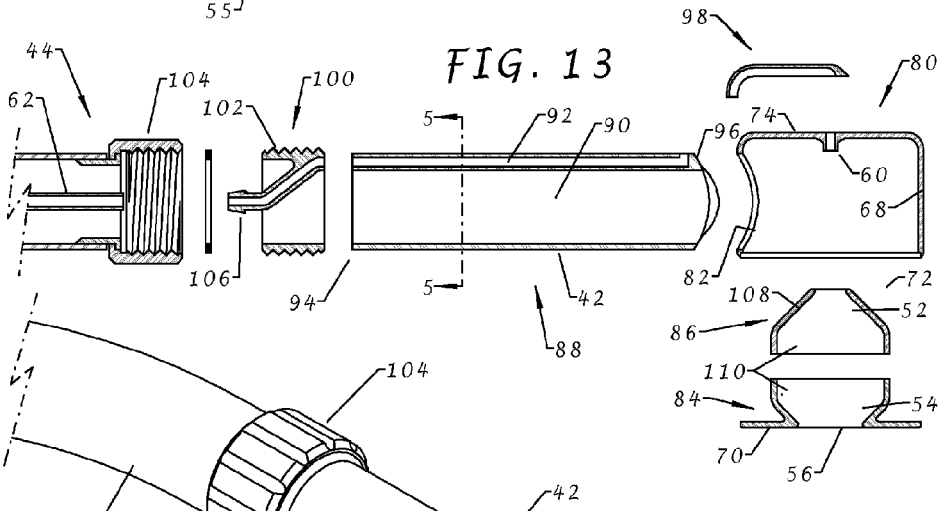
FIG. 13 is an exploded sectioned side view of parts for making a shower head in accordance with the third arrangement of FIGS. 11 and 12.

A third exemplary arrangement of shower head will now be described with reference to FIGS. 11 to 13. The third arrangement is similar to the second arrangement except in the following respects.

First, the convergent portion 46 and divergent portion 52 of the Venturi 48 and the convergent nozzle 54 converge or diverge more steeply than in the first and second arrangements of FIGS. 1 to 10. This conveniently enables a single frusto-conical wall portion 108 to provide (i) on its internal surface the divergent portion 52 of the Venturi 48 and (ii) on its outer surface one of the walls of the convergent portion 46 of the Venturi 48, the other wall of the convergent portion 46 of the Venturi 48 still being provided by the rear end wall 74.

Second, a cylindrical duct portion 110 is provided between the divergent portion 52 of the Venturi 48 and the convergent nozzle 54.

Figure 11:
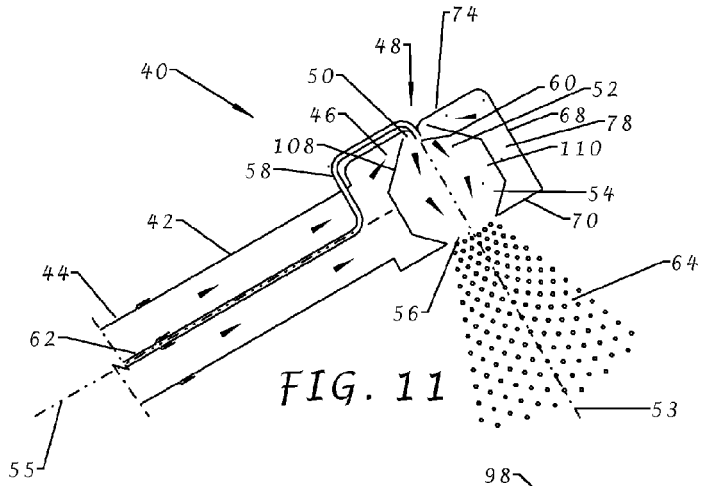
FIG. 11 is a schematic diagram of a third arrangement of shower head in accordance with the present invention.
Figure 12:
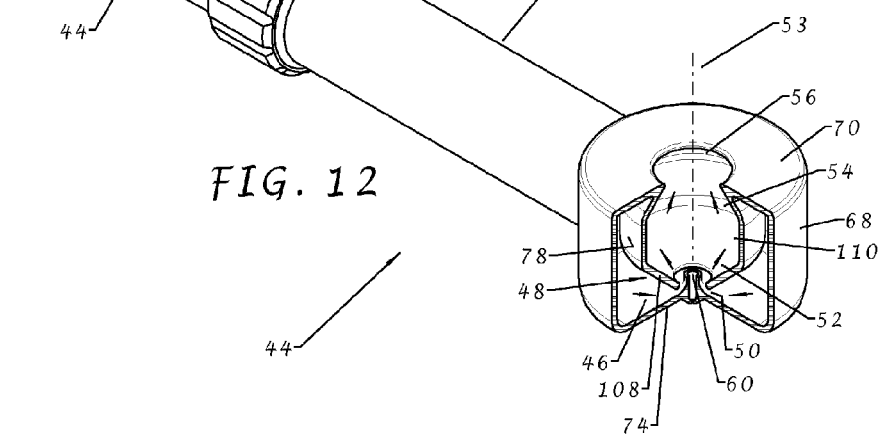
FIG. 12 is a partly cut away isometric view of a shower head in accordance with the third arrangement of FIG. 11.

Although not shown in FIGS. 11 and 12, a baffle may be provided at the distal end of the handle 42 or in the plenum chamber 78 to deflect air away from the region of the convergent portion 46 of the Venturi 48 nearest the handle 42.

With any of the arrangements of FIG. 2, FIGS. 3 to 10 and FIGS. 11 to 13, the air hose 44 is connected to an air blower driven by an electric motor which may be of variable speed. The hot-water hose 62 is connected to a hot-and-cold mixer valve which may be thermostatically controlled. The system may be provided with other features as described in patent document WO2009/056887A1, the content of which is incorporated herein by reference.

Many modifications and developments may be made to the arrangements described above.

For example, a bracket may be provided for releasably mounting the shower head 40 on a wall in a shower cubicle of above a bath, and the handle 42 may be suitably shaped for engagement with the bracket.

Although in FIG. 2 the axes of the air flow directions in the convergent and divergent portions 46,52 of the Venturi 48 are at right angles to each other, and in FIG. 3 the general plane of the air flow in the convergent portion 46 of the Venturi 48 is approximately at right angles to the axis of the air flow direction in the divergent portion 52 of the Venturi 48, angles other than a right angle may be adopted, such as an angle between 60° and 120°, or even an angle between 45° and 135°.

It should be noted that the embodiments of the invention have been described above purely by way of example and that many modifications and developments may be made thereto within the scope of the present invention

The invention claimed is:

1. A shower head for use by a user in showering the human body, having:

a first passageway for carrying a flow of pressurised air from a pressurised air supply, in a general direction via a Venturi having a convergent portion, throat and divergent portion, to a shower discharge opening;

the divergent portion having a central axis and a section area normal to the central axis, the central axis extending centrally through the throat to the shower discharge opening, the section area of the divergent portion increasing progressively in said general direction along the central axis away from the throat and towards the shower discharge opening, the convergent portion constricting the first passageway so that, in use, the flow of pressurised air from the pressurised air supply is accelerated as it passes through the convergent portion; and a second passageway for carrying a flow of water from a water supply to a water discharge opening in the Venturi;

wherein a convergent nozzle is arranged downstream of the divergent portion of the Venturi, the convergent nozzle having a section area normal to the central axis, the section area of the convergent nozzle decreasing progressively in said general direction along the central axis away from the divergent portion and towards the shower discharge opening;

the water discharge opening and the Venturi being arranged so that, in use, the water is discharged from the water discharge opening and entrained in the flow of pressurised air so that it breaks up within the shower head into droplets which are carried with the flow of pressurised air through the convergent nozzle and out of the shower discharge opening as a spray comprising a shower of droplets in which the user may shower; and wherein a plenum chamber is arranged to surround at least a portion of the Venturi which is arranged radially inwardly of the plenum chamber, said plenum chamber being configured to communicate with a periphery of the convergent portion so as to distribute the air around said periphery so that the air flows from said periphery towards the central axis and turns through a substantial angle in the Venturi.

2. A shower head as claimed in claim 1, wherein:

the general direction of the flow of air is turned through said substantial angle at or adjacent the throat of the Venturi.

3. A shower head as claimed in claim 1, wherein:

the convergent and divergent portions are substantially in axial alignment.

4. A shower head as claimed in claim 1, wherein:

the divergent portion and the shower discharge opening are substantially in axial alignment.

5. A shower head as claimed in claim 1, wherein:

the Venturi is arranged such that, in use, the flow of air in the convergent portion of the Venturi is radially or conically convergent towards the throat of the Venturi.

6. A shower head as claimed in claim 5, wherein:

the shower head includes a housing having a rear wall;

a frusto-conical wall is disposed within the housing, the frusto-conical wall tapering to a smaller diameter end in a direction towards the rear wall and being spaced from the rear wall;

the convergent portion of the Venturi is provided between the rear wall and an outer surface of the frusto-conical wall; and the throat of the Venturi is provided at least in part between the rear wall and the smaller diameter end of the frusto-conical wall.

7. A shower head as claimed in claim 6, wherein:

the divergent portion of the Venturi is defined by an inner surface of the frustoconical wall.

8. A shower head as claimed in claim 7, wherein:

the shower head includes an elongate handle having a distal end for connection to the air supply;

the plenum chamber is provided adjacent a proximal end of the handle; and the first passageway extends through the handle from the distal end of the handle to the plenum chamber.

9. A shower head as claimed in claim 8, wherein:

the plenum chamber surrounds the divergent portion of the Venturi.

10. A shower head as claimed in claim 1, wherein:

said substantial angle is between 45° and 135°.

11. A shower head as claimed in claim 1, wherein:

the water discharge opening is disposed at or adjacent a beginning of the divergent portion of the Venturi.

12. A shower head as claimed in claim 1, wherein:

the shower head is devoid of a rose or the like adjacent the shower discharge opening.

13. A shower apparatus, comprising:

a shower head as claimed in claim 1;

an air blower; and a flexible air hose for connecting the air blower to the first passageway of the shower head.

14. A shower apparatus as claimed in claim 13, wherein:

a flexible water hose is provided for connecting a water supply to the second passageway of the shower head; and wherein the water hose extends to the shower head within the air hose.

* * * * *